US005579732A

United States Patent [19]

Hajek

[11] Patent Number: 5,579,732

[45] Date of Patent: Dec. 3, 1996

[54] ELECTROMECHANICAL VALVE SYSTEM

[76] Inventor: Wade A. Hajek, 6180 Eastmoreland Dr., Burton, Mich. 48509

[21] Appl. No.: 595,443

[22] Filed: Feb. 5, 1996

[51] Int. Cl.[6] ..... F01L 7/10

[52] U.S. Cl. ..... 123/190.14; 123/190.2; 123/80 R; 251/129.06; 251/315.01

[58] Field of Search ..... 123/190.14, 190.2, 123/80 R; 251/129.06, 129.14, 315.01

[56] References Cited

U.S. PATENT DOCUMENTS 4,976,227 12/1990 Draper ..... 123/80 R

*Primary Examiner*—Erick R. Solis
*Attorney, Agent, or Firm*—Donald C. Bolger, P.C.

[57] ABSTRACT

The electromechanical valve system consists of a new system for opening and closing intake and exhaust valves on internal combustion motor vehicle engines by using electric pulses from the electronic control module (ECM) to electromagnets surrounding ball valves equipped with permanent magnets on pivots. It is designed to eliminate the camshaft, rocker arms, lifters, springs, etc., for the engine so the engine weights less but has more power, requires minimal maintenance because of the drastic reduction in moving parts, increases fuel efficiency and allows variable valve timing because valve operation is no longer dependent on the camshaft. The electromechanical valve system uses an input signal from a crank trigger sensor to the engine control module (ECM) which sends electrical pulses to electromagnets around valve ball in which discs are equipped with magnets. The polarity of the electromagnets is varied to achieve a like pole alignment or an opposite pole alignment, which either rotates the ball valve open or rotates them shut.

6 Claims, 3 Drawing Sheets

ELECTROMECHANICAL VALVE SYSTEM

CROSS-REFERENCE TO RELATED APPLICATIONS: None

Statement as to right to inventions made under Federally sponsored research and development: Not Applicable.

BACKGROUND OF THE INVENTION:

The field of the invention is generally that of electromechanical valve systems and mote specifically, to an improved intake and exhaust valve for an engine. The valve can also be used in place of a conventional valve in pneumatic or hydraulic applications.

The electromechanical valve system consists of a valve ball with a hole in it which opens and closes fluid flow through a valve housing. Opening and closing the valve is accomplished by electromagnets around the exterior of the valve and controlled by the on-board engine control module (ECM) and a crank trigger sensor on the front of the crankshaft. The electromechanical valve system is designed to completely eliminate the conventional valve train which would result in a quieter, less expensive and almost maintenance free system when compared to conventional valve trains. The electromechanical valve system also allows the use of variable valve timing.

Conventional four stroke engines utilize a camshaft powered from the crankshaft by a timing belt or chain to open and close exhaust and intake valves in the cylinders. These valve trains include poppet valves that are operated by rocker arms or tappets utilizing valve springs to return the valves to their seats. The power draw on the crankshaft to operate the conventional valve train is 5 to 10 percent of total power output.

In addition, exhaust valve seats are burned from exposure to hot exhaust gases, camshaft lobes wear down, valve springs become weak, stems become worn and an increase in the power of a conventional four stroke engine is circumscribed by the 1:2 speed ratio requirement of the camshaft to crankshaft. A system that incorporates popper valves and dual cams can be used, but it is expensive and requires constant adjustment.

The electromechanical valve system is a new type of valve system that utilizes electromagnets on one or both sides of valve ball to rotate open and close the magnet equipped, valve ball. The ECM PROM chip would be enlarged to accommodate and process the data sent by a crank trigger sensor on the end of the crankshaft and vary the voltage to the electromagnets as to use induction to rotate the valve ball open or rotate it shut.

The substitution of a simple, efficient valve ball and valve housing arrangement in a four stroke reciprocation piston engine eliminates all the independent moving parts in the valve train. This means less wear on moving parts and, therefore, longer life and less repair and adjustment, a quieter engine and less expensive engines, which benefits car manufacturers as well as consumers. Manufacturers would not have to stockpile as many parts, and assembly time would be reduced. Engine re-design and re-tooling would be minimal. This valve system could be used on four, six, and eight cylinder cars and two stroke as well as four stroke engines.

By using a valve housing with female threads, male threads or nipple on both ends the valve can be used in pneumatic and hydraulic applications. The crank trigger and ECM would not be needed. A switch would be used to open and close the valve. An example of where the valve could be used would be a fuel cut off valve.

SUMMARY OF THE INVENTION

The design of the electromechanical valve system calls for a conventional four stroke automobile engine without the camshaft, timing chain or belt, rocker arms, springs, push rods or conventional tappets. A valve housing equipped with electromagnets would be placed into the cylinder head for each intake and exhaust port. The rotating valve ball inside the valve housing would be equipped with magnets and have a hole in it. The electromagnets would be wired to the battery through the ECM with the ECM wired to a crank trigger sensor on the crankshaft. The crank trigger sensor on the crankshaft sends digitized signals to the ECM PROM chip which allows the ECM to determine the position of the piston relative to top dead center and then commands the valve ball to open and close at a pre-defined timing strategy. Thus, at top dead center on the power stroke on number one piston, the ECM would fix the polarity of both electromagnets so that they were of opposite pole of the magnets in the valve ball, rotating the valve ball to the closed position. Similarly, on the intake stroke, the polarity of a given piston intake valve electromagnet would create a magnetic field that would rotate the valve ball open with the exhaust valve electromagnet keeping the ball closed. The amount of engine oil required would be drastically reduced because, no lubrication would be required for the traditional complex popper valve system.

The present invention is an improvement in the way intake and exhaust valves are opened and closed.

It is an object of the present invention to provide a novel method to open and close intake and exhaust valves by an electromotive force.

It is a further object of the invention to provide an novel variable intake and exhaust valve timing using a crank trigger, engine control module and electromechanical valves.

It is another object of the invention to provide a low cost engine intake and exhaust valve timing system.

It is a further object of the invention to provide a flexible design that can easily be adapted to all engines.

It is another object of the invention to provide a simple means to vary intake and exhaust valve timing to increase power and improve fuel economy by pre-programming a timing strategy with an engine control module, a crank trigger, and a electromechanical valve.

Further objects are implicit in the detailed description which follows hereinafter (which is to be considered as exemplary of, but not specifically limiting, the present invention) and said objects will be apparent to persons skilled in the art after a careful study of the detailed description which follows.

For the purpose of clarifying the nature of the present invention, one exemplary embodiment of the invention is illustrated in the herein below described figure of the accompanying drawings and is described in detail hereinafter.

DESCRIPTION OF THE PREFERRED EMBODIMENTS

Figure 1:
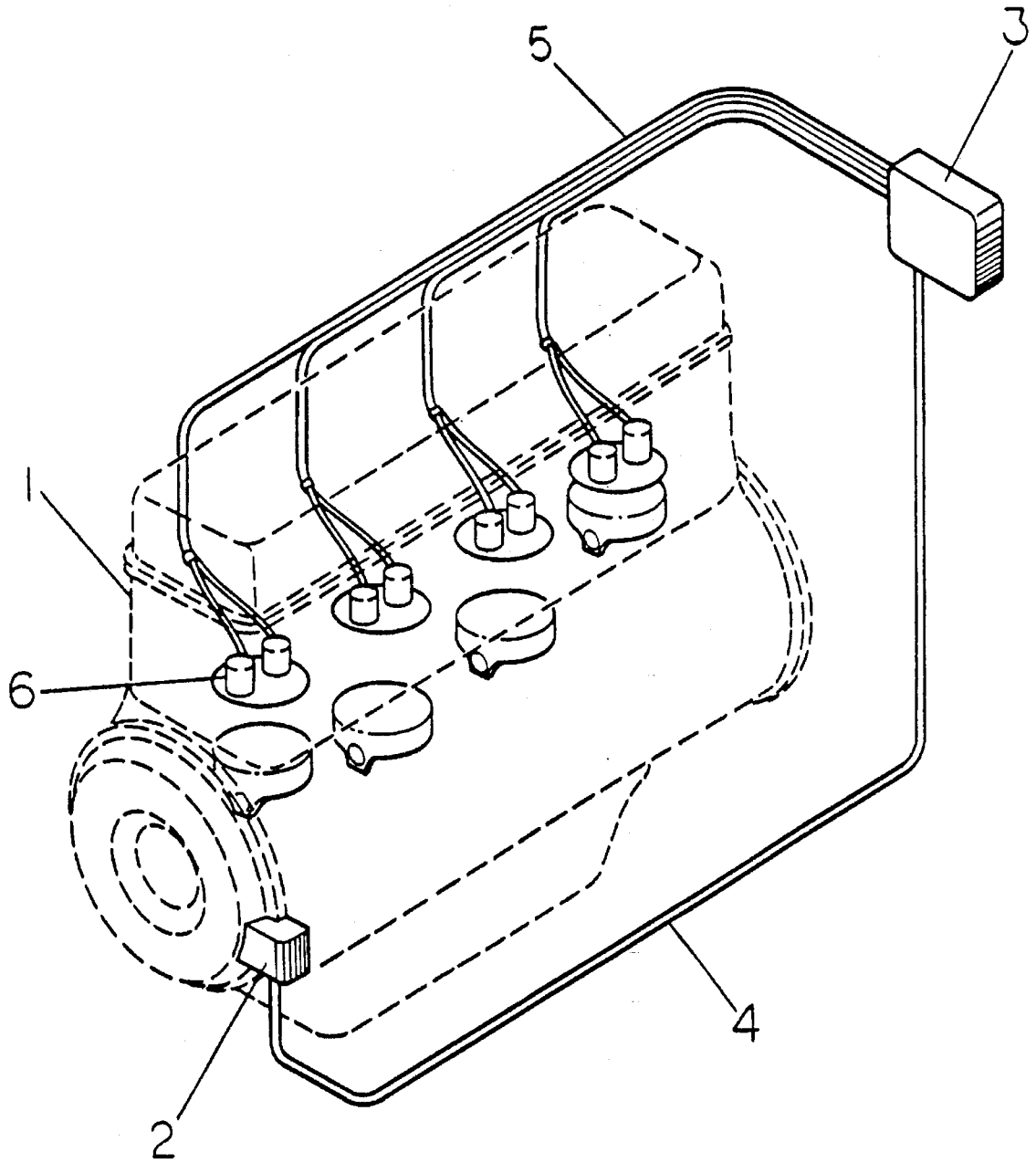
FIG. 1 is an elevation view showing one exemplary embodiment of one representative form of the invention.

Referring to FIG. 1, engine 1 is shown to be a four cylinder engine, however, any combination of cylinders could be used such as a six cylinder or an eight cylinder engine.

Crank trigger 2 is fixedly mounted to engine 1 and measures the position of top dead center of the piston position by using a Hall Effect crank trigger 2 sensor in conjunction with a collector ring attached to the harmonic balancer which sends a reference signal to the engine control module 3. By indexing the reference signal the engine control module 3 can be programmed to know the exact location of the piston in each cylinder. The crank trigger 2 is electrically connected to the engine control module 3 by wire 4. Valve 6 is located in each of the cylinder head of engine 1. Wire harness 5 is connected from each valve 6 to engine control module 3.

Figure 2:
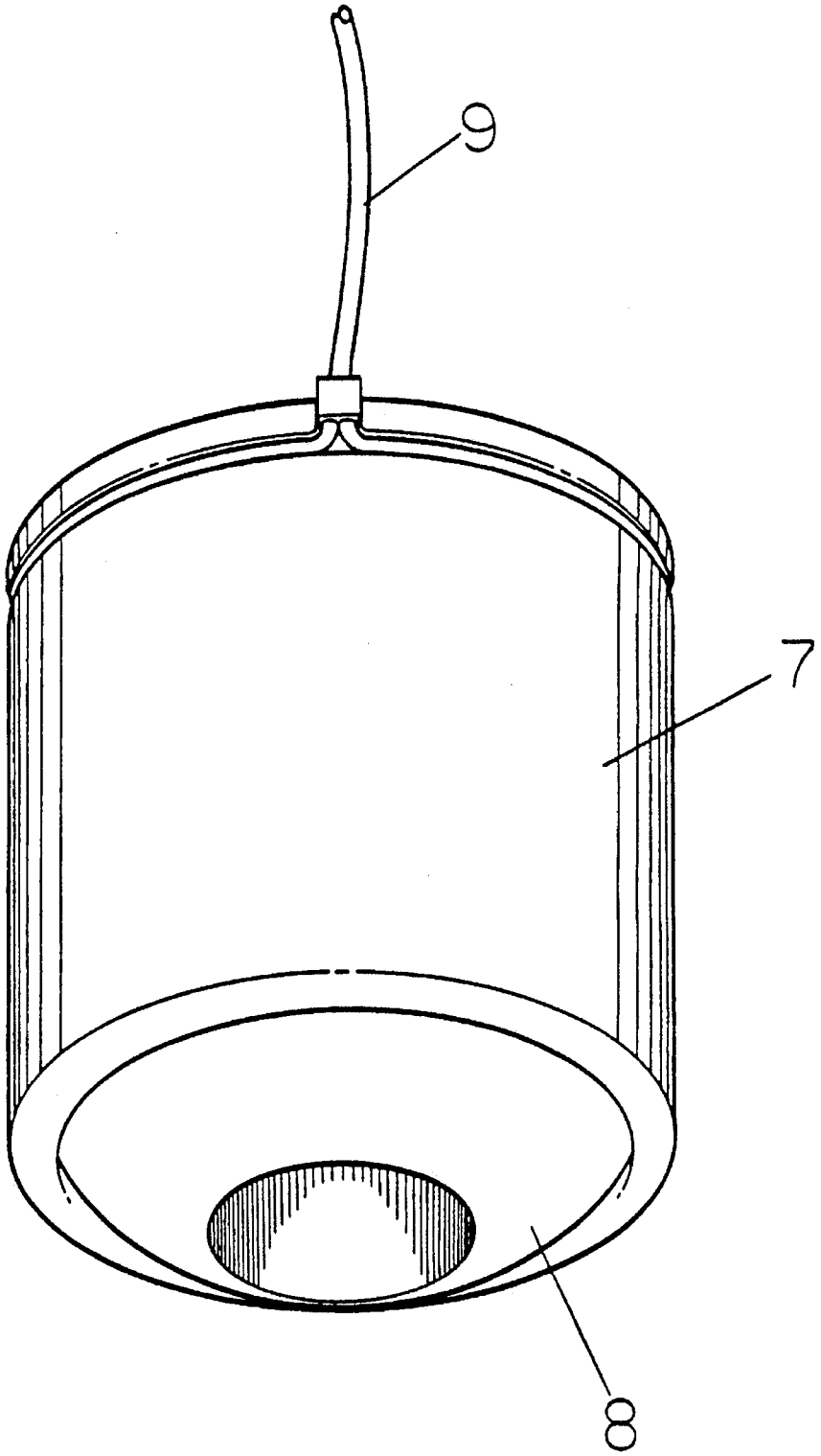
FIG. 2 is an elevation view showing one exemplary embodiment of one representative form of the valve.

Referring to FIG. 2, valve 6 consists of valve housing 7, which contains valve ball 8. Valve housing 7 has wire connection 9 for attaching wire harness 5 to engine control module 3.

Figure 3:
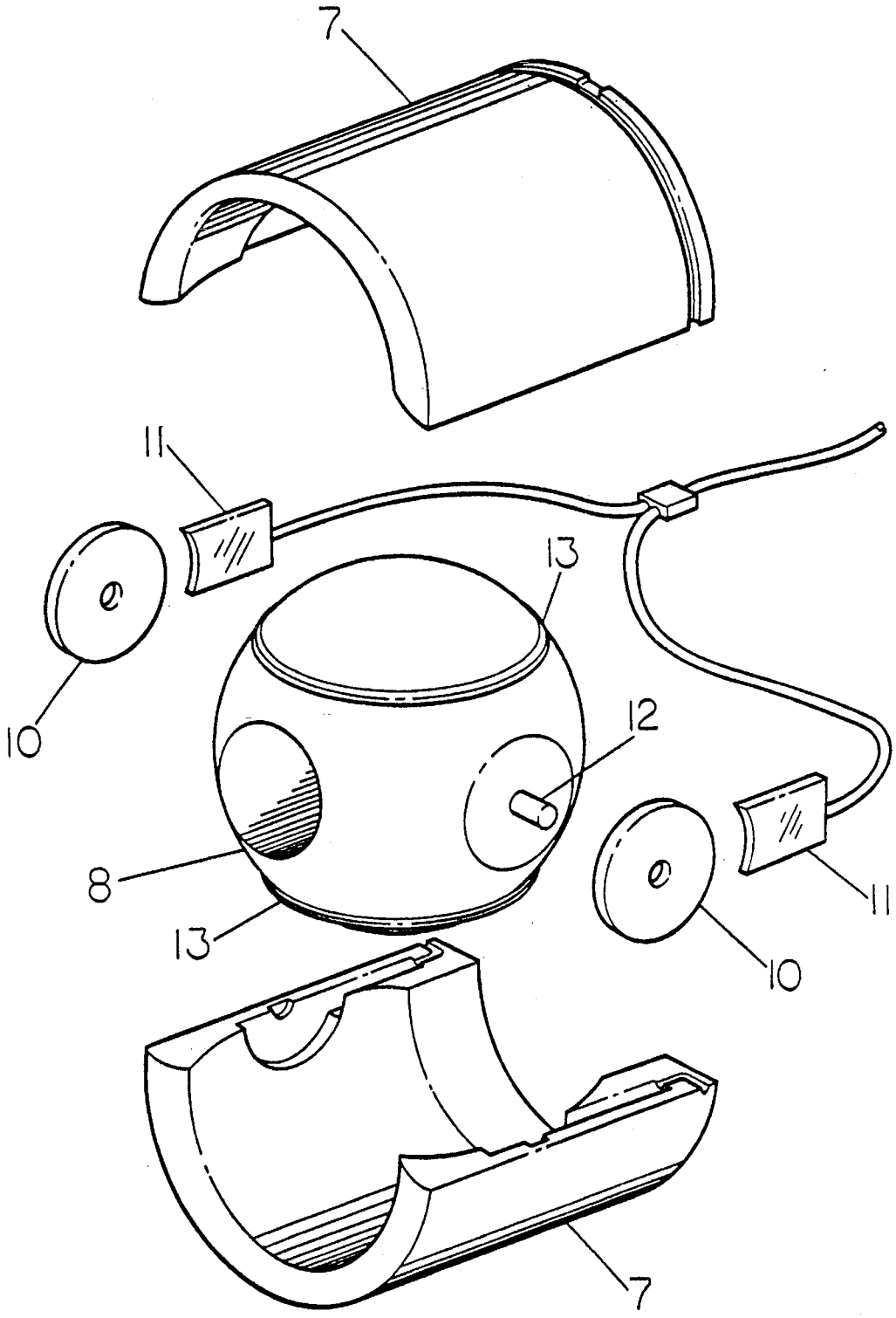
FIG. 3 is an view showing how the electromechanical valve rotates between the open and closed position when the electromagnetic force is applied.

Referring to FIG. 3, valve housing 7 is shown in two pieces, however, a one piece valve housing could also be used. Valve ball 8 has two pivots 12 rigidly attached. Disc 10 contains permanent magnets around its perimeter. Disc 10 is permanently attached and indexed to valve ball 8. Valve 6 may have disc 10 and electromagnet 11 on one side or both sides of valve ball 8. Electromagnets 11 are connected to wire 9 which connects to wire harness 5.

What is claimed is:

1. A electromechanical valve system comprising:

a valve housing having a upper member and a lower member;

a valve ball having a hole, an upper ball seal, a lower ball seal, and a first ball pivot and a second ball pivot;

a first disc magnetically charged having a hole;

a second disc magnetically charged having a hole;

a first electromagnet;

a second electromagnet;

means for attaching said first ball pivot to said first disc;

means for attaching said second ball pivot to said second disc;

means for attached said valve housing upper member to said valve housing lower member allowing said valve ball to rotate through an axis through said first ball pivot and second ball pivot and also locating said first electromagnet near said first disc and locating said second electromagnet near said second disc whereby an electrical signal applied to said first electromagnet and said second electromagnet will rotate said valve ball in the open or closed position.

2. A device as recited in claim 1 having only one electromagnet and only one disc.

3. A electromechanical valve system in conjunction with an intake/exhaust port of an engine having a engine control module, and crank trigger comprising:

a valve housing having a upper member and a lower member;

a valve ball having a hole, an upper ball seal, a lower ball seal, and a first ball pivot and a second ball pivot;

a first disc magnetically charged having a hole;

a second disc magnetically charged having a hole;

a first electromagnet;

a second electromagnet;

means for attaching said first ball pivot to said first disc;

means for attaching said second ball pivot to said second disc;

means for attached said valve housing upper member to said valve housing lower member allowing said valve ball to rotate through an axis through said first ball pivot and second ball pivot and also locating said first electromagnet near said first disc and locating said second electromagnet near said second disc whereby an electrical signal applied to said first electromagnet and said second electromagnet will rotate said valve ball in the open or closed position.

4. A device as recited in claim 3 having only one electromagnet and only one disc.

5. A electromechanical valve system in conjunction with an intake/exhaust port of an engine comprising:

a valve housing having a upper member and a lower member;

a valve ball having a hole, an upper ball seal, a lower ball seal, and a first ball pivot and a second ball pivot;

a first disc magnetically charged having a hole;

a second disc magnetically charged having a hole;

a first electromagnet;

a second electromagnet;

means for attaching said first ball pivot to said first disc;

means for attaching said second ball pivot to said second disc;

means for attached said valve housing upper member to said valve housing lower member allowing said valve ball to rotate through an axis through said first ball pivot and second ball pivot and also locating said first electromagnet near said first disc and locating said second electromagnet near said second disc whereby an electrical signal applied to said first electromagnet and said second electromagnet will rotate said valve ball in the open or closed position;

a crank trigger;

an engine control module;

connection means for communicating said crank trigger to said engine control module where said engine control module is programmed to open and close said ball valve to a predetermined valve timing strategy.

6. A device as recited in claim 5 having only one electromagnet and only one disc.

* * * * *